US009027638B2

(12) United States Patent
Madison et al.

(10) Patent No.: US 9,027,638 B2
(45) Date of Patent: May 12, 2015

(54) CYCLIC STEAM STIMULATION USING RF

(75) Inventors: Maxine Jones Madison, Houston, TX (US); Wayne Reid Dreher, College Station, TX (US); Francis Eugene Parsche, Palm Bay, FL (US); Mark Alan Trautman, Melbourne, FL (US)

(73) Assignees: ConocoPhillips Company, Houston, TX (US); Harris Corporation, Melbourne, FL (US)

( * ) Notice: Subject to any disclaimer, the term of this patent is extended or adjusted under 35 U.S.C. 154(b) by 544 days.

(21) Appl. No.: 13/233,596

(22) Filed: Sep. 15, 2011

(65) Prior Publication Data

US 2012/0085533 A1 Apr. 12, 2012

Related U.S. Application Data

(60) Provisional application No. 61/383,230, filed on Sep. 15, 2010, provisional application No. 61/466,342, filed on Mar. 22, 2011.

(51) Int. Cl.
*E21B 43/24* (2006.01)

(52) U.S. Cl.
CPC ..... *E21B 43/2408* (2013.01)

(58) Field of Classification Search
CPC ..... E21B 43/24; E21B 43/2401
USPC ..... 166/248, 272.1, 272.3, 303
See application file for complete search history.

(56) References Cited

U.S. PATENT DOCUMENTS

| | | | |
|---|---|---|---|
| 6,189,611 | B1 | 2/2001 | Kasevich |
| 2009/0020456 | A1 | 1/2009 | Tsangaris et al. |
| 2009/0090509 | A1 | 4/2009 | Vinegar et al. |

FOREIGN PATENT DOCUMENTS

WO PCT/US11/51740 2/2012

OTHER PUBLICATIONS

Clark, Paul Alexander. "New Catalysts for Hydroprocessing: Molybdenum and Tungsten Phosphide", Sep. 29, 2000. Chapter 2.*

* cited by examiner

*Primary Examiner* — David Bagnell
*Assistant Examiner* — Kristyn Hall
(74) *Attorney, Agent, or Firm* — Boulware & Valoir

(57) ABSTRACT

A method of producing hydrocarbons from a well. The method begins by injecting steam into a well. The bitumen in the formation is then heated with the injected steam, followed by ceasing the injection of steam into the well and then by soaking the bitumen with the injected steam and collecting the heated oil. Steam that has condensed is revaporized by directing RF/MW radiation to the steam allowing for more bitumen to be produced without injecting more steam. In addition, some of the steam could become superheated, wherein the temperature of the superheated steam is greater than the temperature of the steam. The bitumen is heated by the revaporized steam and the superheated steam, followed by soaking the bitumen with the revaporized steam and the superheated steam. Hydrocarbons are then produced from the well.

14 Claims, 4 Drawing Sheets

CYCLIC STEAM STIMULATION USING RF

PRIOR RELATED APPLICATIONS

This invention claims priority to U.S. Provisional Nos. 61/383,230 filed Sep. 15, 2010 and 61/466,342 filed on Mar. 22, 2011, each incorporated by reference in its entirety herein.

FIELD OF THE INVENTION

This invention relates to enhanced recovery techniques aimed to upgrade heavy crude oils and bitumen within the subsurface of the earth, and particularly to enhanced recovery techniques to be used with cyclic steam stimulated recovering technology that uses radio frequency heating technology to upgrade the heavy crude oils and bitumen.

BACKGROUND OF THE INVENTION

The production of heavy oil and bitumen from a subsurface reservoirs such as oil sands or shale oil is challenging. One of the main reasons for the difficulty is the viscosity of the heavy oil or bitumen in the reservoir. At reservoir temperature the initial viscosity of the oil is often greater than one million centipoises, which is difficult to produce if not mobilized using external heat. Therefore, the removal of oil from the reservoir is typically achieved by introducing sufficient energy into the reservoir to heat the reservoir, such that the viscosity of the oil is reduced sufficiently to facilitate oil production.

Currently the preferred method of introducing energy into the reservoir is steam injection. The heat from the steam reduces the viscosity of the fluid, allowing it to flow toward production wells. The steam also provides voidage replacement to maintain the pressure in the reservoir. There are several variations on steam injection methods of producing heavy oil, including Cyclic Steam Stimulation (CSS), steam drive, and Steam Assisted Gravity Drainage (SAGD), but all of these methods use steam for heating and maintaining pressure in the reservoir.

Cyclic steam stimulation or CSS was accidentally discovered by Shell while doing a steam flood in Venezuela and one of its steam injectors blew out. The well produced oil at much higher rates than a conventional production well in a similar environment, leading to the realization that steam injection could improve production. CSS, also known as the Huff and Puff method, consists of 3 stages: injection, soaking, and production. Steam is first injected into a well for a certain amount of time to heat the oil in the surrounding reservoir to a temperature at which it flows. After it is decided enough steam has been injected, the steam is usually left to "soak" for some time after (typically not more than a few days). Then oil is produced out of the same well, at first by natural flow (since the steam injection will have increased the reservoir pressure) and then by artificial lift. Production will decrease as the oil cools down, and once production reaches an economically determined level the steps are repeated again. This process is shown schematically in FIG. 1.

CSS can be quite effective, especially in the first few cycles. However, it is typically only able to recover approximately 20% of the Original Oil in Place (OOIP), compared to steam flooding, which has been reported to recover over 50% of OOIP. It is quite common for wells to be produced in the cyclic steam manner for a few cycles before being put on a steam flooding regime with other wells.

CSS and steam flooding are quite distinct processes in the petroleum industry. In a steam flood, sometimes known as a steam drive, some wells are used as steam injection wells and other wells are used for oil production. Two mechanisms are at work to improve the amount of oil recovered. The first is to heat the oil to higher temperatures and to thereby decrease its viscosity so that it more easily flows through the formation toward the producing wells. A second mechanism is the physical displacement employing in a manner similar to water flooding, in which oil is meant to be pushed to the production wells. While more steam is needed for this method than for the cyclic method, it is typically more effective at recovering a larger portion of the oil.

Radio frequencies (RF) have been used in various industries for a number of years. One common use of this type of energy is the household cooking appliance known as the microwave (MW) oven. Microwave radiation couples with, or is absorbed by, non-symmetrical molecules or those that possess a dipole moment, such as water. In cooking applications, the microwaves of about 2.4 GHz are absorbed by water present in food. Water vapor molecules, in contrast, are known to absorb at about 22 GHz. Once the water absorbs the MW, the water molecules rotate and generate heat, thus heating the remaining molecules through a conductive heating process.

RF has also been used in various downhole applications, but to our knowledge has never been applied in a CSS method to improve CSS efficiencies.

U.S. Pat. No. 6,189,611 describes the application of cyclically applied RF energy radiated at a power of 10 kilowatts (KW) and a frequency of 27.12 megahertz (MHz). When the temperature at the applicator well reaches about 140° C., the radiation power is cycled down to 8 to 9 KW, typically for a period of several hours, until the temperature of the applicator well cooled to about 130° C., and then the power was cycled back to 10 KW. The inventors describe the production of oil as occurring in spikes, similar to the way oil is produced in huff and puff methods. However, this method is not a true combination of CSS and RF reheating. Instead, it uses RF to replace steam injection. Thus, the method fails realize the benefits of combining CSS with RF reheating.

Thus, there exists a need to combine the technology of conventional cyclic steam stimulation with RF technologies to both increase the amount of oil produced from the reservoir and in situ upgrade the oil in the reservoir, while reducing the time required for draining the water condensed from the injected steam and re-injection of steam for next cycle.

SUMMARY OF THE INVENTION

The present invention provides a method of producing hydrocarbons from a well that combines CSS with RF reheating of the steam to continue the CSS process. This method realizes the important benefits of CSS, but with the improved efficiencies created by reheating the steam with RF (reducing water usage) and in some cases allowing in situ upgrading of the heavy oil when the heating level is sufficiently high.

The method begins by injecting steam into a well as in a regular SCC process. This is followed a soaking period, wherein the heat from the steam is allowed to transfer to the bitumen or heavy oil. After the soak, the heated oil is then collected. When production levels drops off, the steam that has condensed is revaporized by directing RF/MW radiation to the steam, allowing for more bitumen or heavy oil to be produced without injecting more steam. In addition, some of the steam can be superheated, thus allowing upgrading reactions to occur, and further reducing oil viscosity. Soak and production periods follow, followed by repeating the RF reheating cycle. The cyclic can be repeated until it loses its cost effectiveness. If steam is lost due to cracks in the reservoir, additional steam can be added, but assuming no losses, the CSS can be performed with a single steam injection, thus greatly conserving this precious resource.

The invention also provides a method of producing hydrocarbons from a well. The method begins by injecting steam into a well. This is followed by ceasing the injection of steam into the well and by soaking the bitumen with the injected steam so that the bitumen in the formation is then heated with the injected steam to a temperature ranging from 200° C. to 250° C. The liquefied heavy oil is then produced, until production levels fall of or become insufficiently cost effective. Then, the Huff and Puff procedure continues, but with an RF reheat, rather than a new injection of steam.

If desired, a catalyst can be used to further allow in situ upgrading. The catalysts can be co-injected with the steam, or injected before or after, can be injected as a liquid or as a slurry. The catalyst can be any upgrading catalyst known in the art.

The following abbreviations are used herein:

| | |
|---|---|
| MW | Microwave |
| RF | Radio frequency |
| CSS | Cyclic steam stimulation |
| OOIP | Original Oil in Place |

As used herein "soaking" is defined as the process of allowing the hydrocarbons in the formation to be heated by the injected steam while the steam diffuses through the formation. The soaking period varies, but operators of ordinary skill in the art know how to balanced soak time with effectiveness.

As used herein "superheated steam" refers to steam that is heated, by radio frequency or microwave, to a temperature higher than that of the initially injected steam or the revaporized steam. The temperature of the superheated steam is preferably sufficiently high to catalytically crack the hydrocarbon. The temperature of the superheated steam, in one embodiment, is greater than 250° C., 300° C. or preferably greater than 350° C. Of course, the temperature may be lower if pressures are higher, so the temperatures provided are only a guideline and are adjusted downwards with increasing pressure and/or catalysts.

As used herein "refractory type metal" refers to a group of metals that have high melting points. Refractory type metals may include, but not limited to, niobium, molybdenum, tantalum, tungsten or rhenium.

As used herein "upgrading" refers to chemical and/or physical reactions that breaks down the hydrocarbon into molecules of lower carbon number or removes impurities from the crude oil. Through the reduction of size and removal of impurities the quality of the crude oil can be improved, thus facilitating subsequent processing and saving operational costs.

The term "hydroprocessing" may include hydrotreating, hydrocracking desulfurization, olefin and aromatic saturation/reduction, or similar reactions that involves the use of hydrogen. Through hydroprocessing the viscosity of the crude oil may be reduced, thus more readily produced and transported.

As used herein "cracking" refers to the reduction of molecular size and/or weight of the hydrocarbons to be produced. Cracking may include, but not limited to, thermal cracking, hydrocracking, fluid catalytic cracking and steam cracking.

The term "transmitter" is defined as an electronic device that generates radio energy through an antenna. Generally speaking, a transmitter generates a radio frequency alternating current that applies to an antenna, which in turn radiates radio waves upon the excitement of the alternating current.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

DESCRIPTION OF EMBODIMENTS OF THE INVENTION

Figure 1:
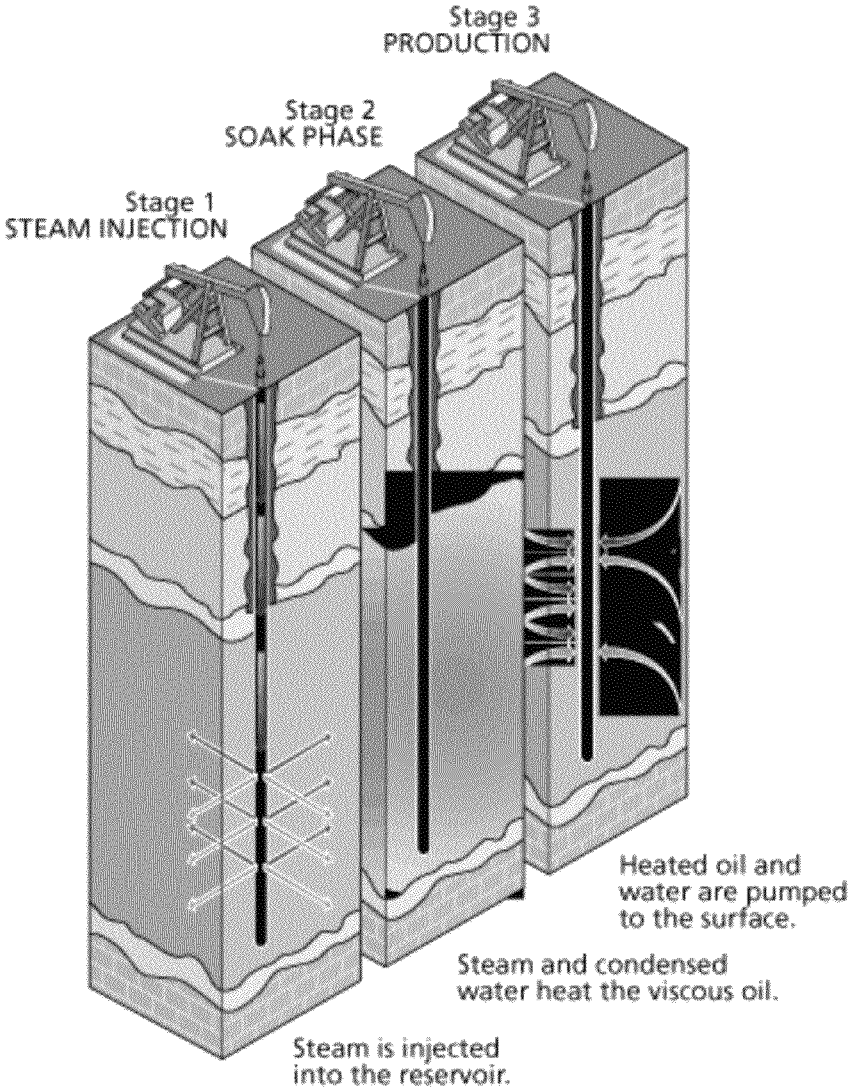
FIGURE 1 (PRIOR ART)
FIG. 1 shows a typical CCS process.

As discussed above, the inventive method combines traditional steam injection, soak, and production cycles with RF re-heating to repeat the cycles in place of additional injections of steam. Further, to the extent that pressures and temperatures are high enough, upgrading and/or cracking of the heavy oil can occur, and this process can occur at lower pressures and temperatures if downhole catalysts are also employed.

The composition of the catalyst may be formulated to concentrate or enhance the MW/RF heating fields in the embedding region, and/or to facilitate various upgrading reactions. Catalysts with metal composition can possess sufficient electrical conductivity such that they become an effective electromagnetic susceptor. The electrical conductivity can also concentrate the MW/RF fields around the catalyst and result in increased localized heating of the hydrocarbon resource in the proximate region of the catalyst. In this manner the MW/RF energy is contained within or near the region of the catalyst and efficiently heats the resource to the target upgrading temperature. Less RF penetration beyond the catalyst region results in a more energy efficient implementation of in-situ upgrading since upgrading temperatures at the catalyst can be achieved with lower RF power levels.

RF and/or MV frequency radiation are directed towards underground steam that may be condensing. In other words, liquid water may be precipitating from a region of steam and thus an oscillating electromagnetic (EM) energy provided in that region. The RF EM energy is transmitted through the steam and absorbed in the condensed steam, though the invention is not so limited and the steam may be excited for increased speed.

The frequencies of the radiation are preferably between 100 and 1000 MHz, which provide the required dissipation without reflection. The relative permittivity of liquid water is approximately 81 throughout this range. The polar water molecule attains increased kinetic energy in the presence of the electromagnetic energy to provide the heat for further heating the reservoir/heavy oils.

The RF and MW radiation are provided by an underground antenna or transmitter proximate the steam, condensed water and hydrocarbons. In a preferred embodiment the underground antenna conveys radio frequency and microwave frequency electric currents that are transduced into radiated energy by the Maxwellian functions. The underground antenna may be provided the electric currents by a surface transmitter and with a transmission line therebetween.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present embodiment discloses a method of producing hydrocarbons from a well. The method begins by injecting steam into a well. The bitumen in the formation is then heated with the injected steam, followed by ceasing the injection of steam into the well and then by soaking the bitumen with the injected steam. Steam that has condensed is revaporized by directing RF/MW radiation to the steam allowing for more bitumen to be produced without injecting more steam. In addition, some of the steam can become superheated, wherein the temperature of the superheated steam is greater than the original temperature of the steam. The bitumen is heated by the revaporized steam and the superheated steam, followed by soaking the bitumen with the revaporized steam and the superheated steam. Hydrocarbons are then produced from the well.

In one embodiment a RF antenna is installed on the vertical well used for CSS. Once steam is injected and is allowed to condense prior to production, the RF antenna will be turned on to heat the mobilized oil and water phase to a temperature higher than is obtainable by steam alone. The target temperature for this stage will be one sufficiently high enough to catalytically crack the oil in the reservoir. The upgraded oil can be produced from the same vertical well, and can be produced after the first steam injection and soak cycle, as well as the subsequent RF and soak cycles, or can be produced only after the various RF and soak cycles, thus omitting the first potential collection period.

In one embodiment the temperature of the steam can range from 220° C. to 250° C., 250-350° C. or preferably greater than 350° C. The temperature of the revaporized steam can range from upwards of 250° C. or 350° C. when the superheated steam is accounted for. The increased temperature of the superheated steam allows for the superheated steam to heat the bitumen to a temperature higher than was previously possible by steam alone. In one embodiment the temperature of the superheated steam would be sufficient to catalytically crack the oil in the reservoir. In one embodiment, the temperature of the superheated steam ranges from 220° C. to 350° C. or more to allow it to catalytically crack the bitumen/oil. It may also be advantages to provide $O_2$ or $H_2$ gas to further improve such upgrading reactions.

In one embodiment a catalyst can be used in the method and can be present either as particles within the reservoir or as a liner on the wall of the well. The addition of catalysts can decrease the viscosity and increase the API gravity of the oil produced as compared to traditional cyclic steam stimulation. Types of catalyst that can be utilized include metal sulfides, metal carbides and other refractory type metal compounds. Examples of metal sulfides include MoS2, WS2, CoMoS, NiMoS and other commonly known by one skilled in the art. Examples of metal carbides include MoC, WC and others commonly known by one skilled in the art. Examples of refractory type metal compounds include metal phosphides, borides and others commonly known by one skilled in the art.

Hydrogen gas can also be added to the injected steam, the revaporized steam and/or the superheated steam either downhole or on the surface to stabilize the hydrocarbons so that it is easily transportable. In one embodiment it is preferred that it is added at a partial pressure from 600 to 800 psi or even 50 to 1,200 psi.

Hydroprocessing type reactions are expected to occur during upgrading and these typically consist of reactions aimed at removing impurities such as S, N and metal. Removal of these impurities can improve the quality of the crude. Hydrogen assisted removal of oxygen can lower the acid number of the crude and the reduction of aromatics will produce "lighter" hydrocarbons, which result in a higher API gravity. Potential hydrocracking or isomerization reactions can provide lower carbon number branched hydrocarbons producing a lower viscosity crude. It is anticipated that some combination of all of the above reactions will occur to give a higher quality crude.

Because the bitumen in the reservoir is initially mobilized using steam, the expected temperature near the wellbore should be approximately 220° C. to 250° C. Higher temperatures are needed for effective upgrading. Therefore, a RF antenna is installed to address this issue.

In another embodiment, a horizontal well CSS approach may be utilized. This will impact a larger region of the reservoir and create a lower surface disturbance as compared to the traditional vertical well process.

In one embodiment heating of the bitumen can occur via ultra low frequency resistive heating, alternating current heating, induction heating or any other currently known method of heating the reservoir, so as to heat the reservoir to upgrading temperatures.

The following examples are illustrative only, and are not intended to unduly limit the scope of the invention.

Example 1

Catalyst as Liner of Well

Figure 2:
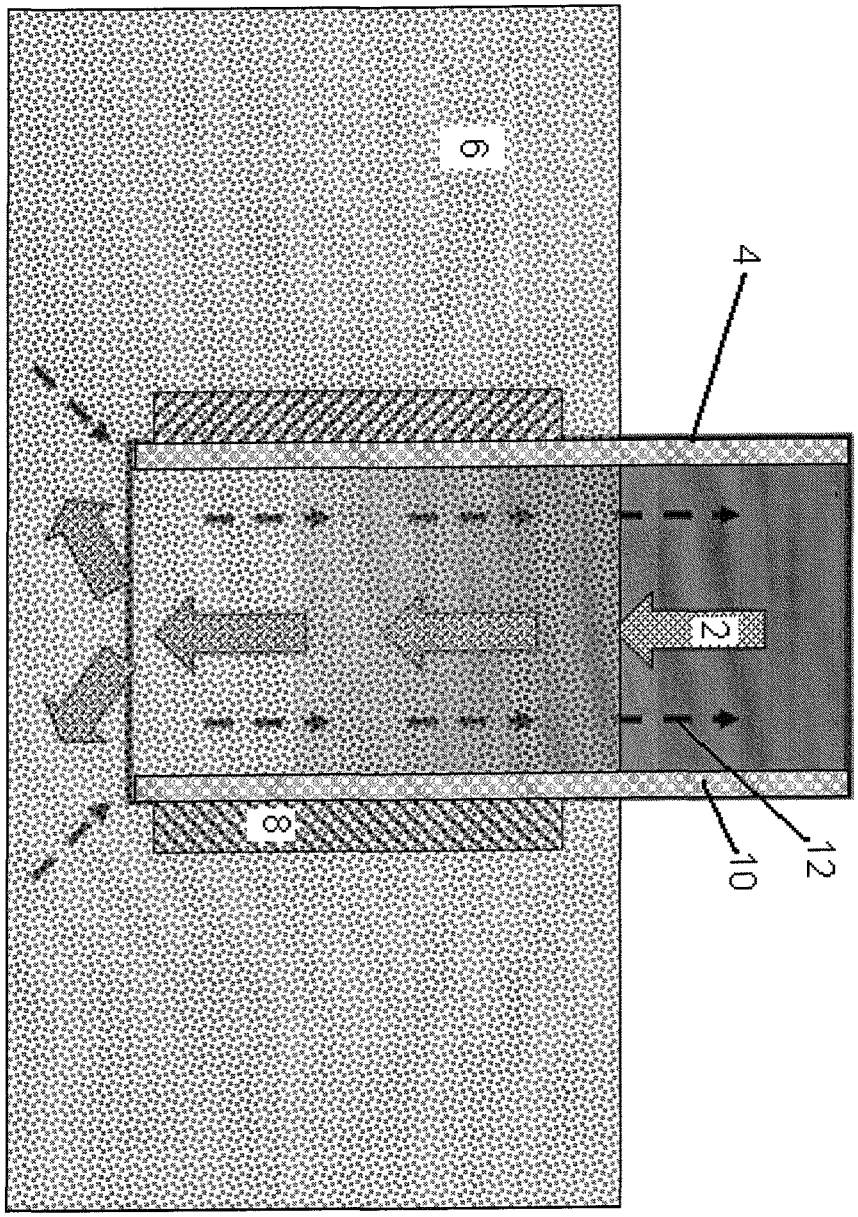
FIG. 2 depicts an embodiment of cyclic steam stimulation, wherein a catalyst is placed as a liner alongside the well.

FIG. 2 describes an embodiment of cyclic steam stimulation, wherein a catalyst is placed as a liner alongside the well. In this embodiment steam 2 is injected into a well 4. The steam 2 heats the bitumen 6 in the formation. When the required temperature is achieved the injection of steam 2 into the well 4 is ceased. The bitumen 6 is soaked with the steam 2 for a period of time. MW and/or RF radiation is then directed into the well from a MW/RF antenna 8. Here the MW/RF antenna 8 is configured to surround the bottom of the well 4 so as to reheat the injected steam before the steam exits the well. The antenna can also be gusseted within the well.

In this embodiment the catalyst 10 is placed as a liner alongside the well 4. The MW and/or RF radiation is capable of heating the steam 2 into superheated steam and revaporized steam, which has a higher temperature than that of the initially injected steam. The bitumen 6 is then further heated with this superheated steam and any steam that has revaporized. Hydrocarbons 12 are then produced from the well 4.

Example 2

Catalyst in the Hydrocarbon Formation

Figure 3:
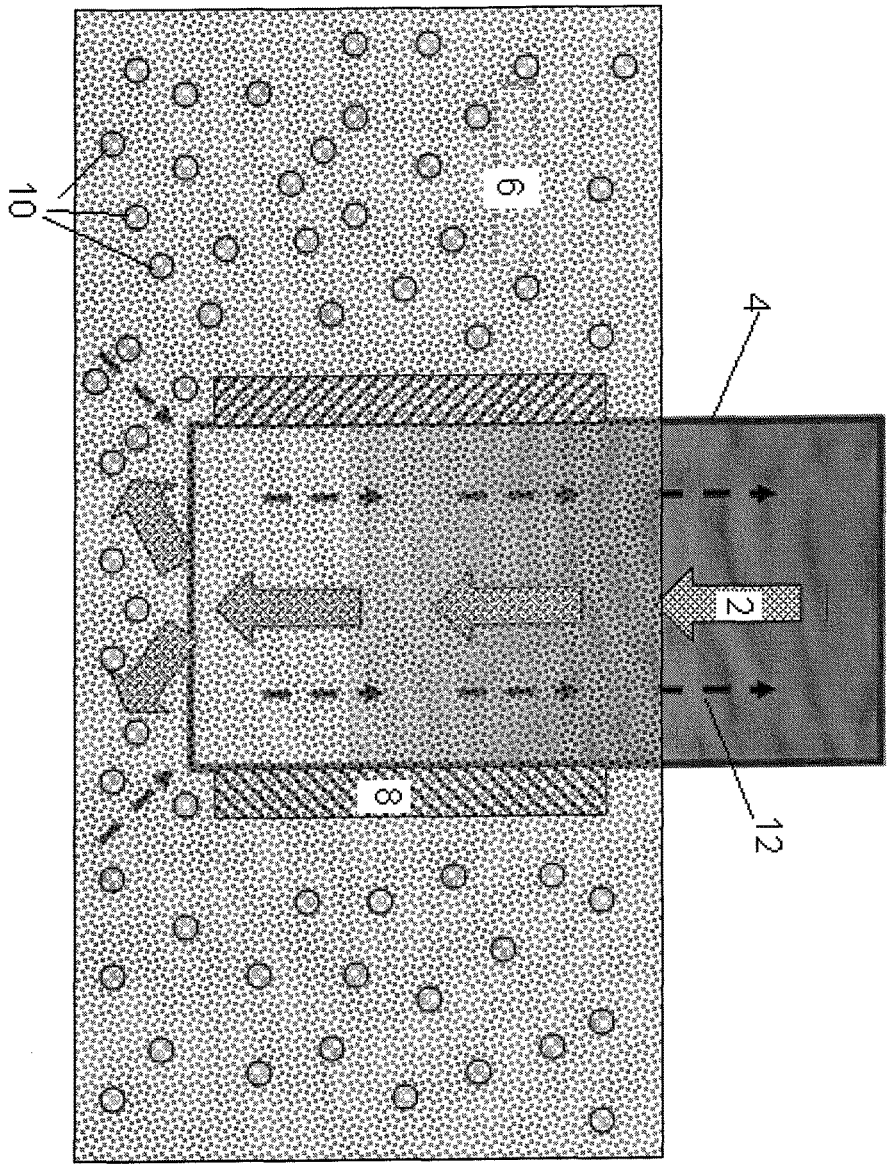
FIG. 3 depicts an embodiment of cyclic steam stimulation, wherein a catalyst is placed as particles in the formation.
Figure 4:
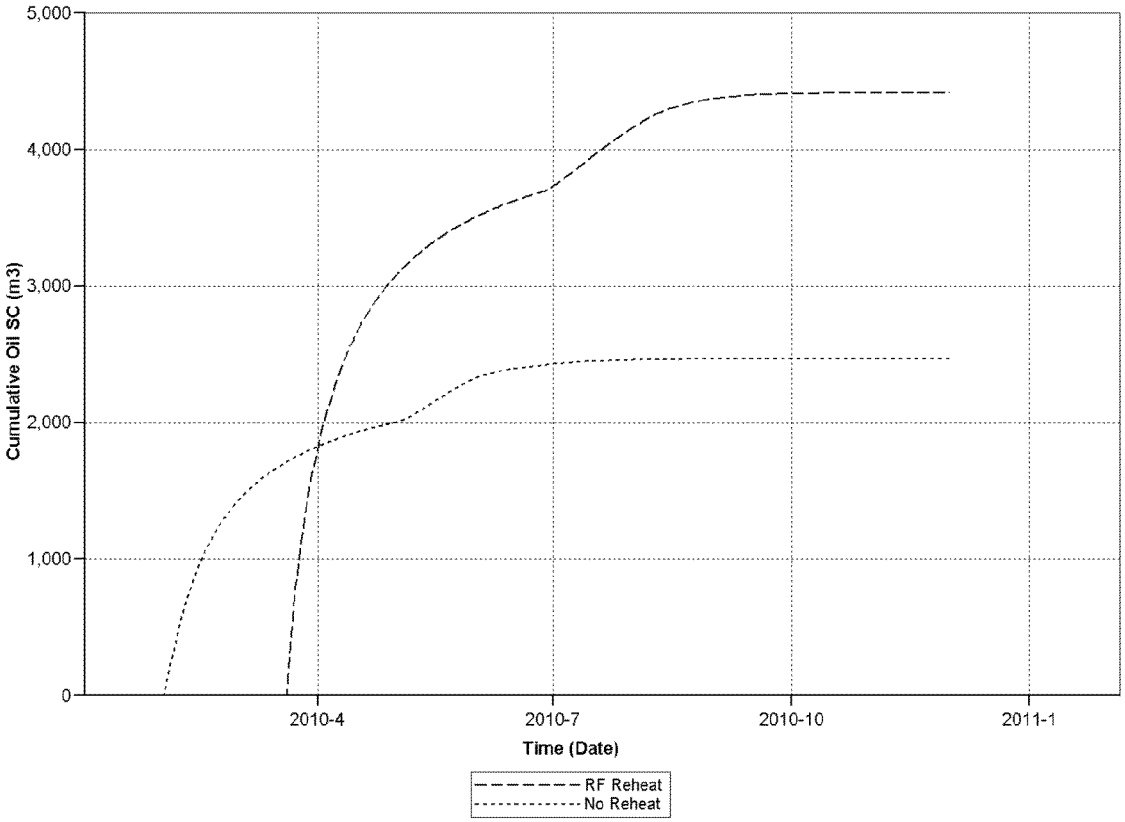
FIG. 4 shows the comparison of cumulative oil SC (surface condition) between RF-reheated and non-heated wells.

FIG. 3 describes an embodiment of cyclic steam stimulation, wherein a catalyst is placed as particles in the hydrocarbon formation. In this embodiment steam 2 is injected into a well 4. The steam 2 heats the bitumen 6 in the formation. When the required temperature is achieved the injection of steam 2 into the well 4 is ceased. The bitumen 6 is soaked with the steam 2 for a period of time. MW and/or RF radiation is then directed into the well 4 from a MW/RF antenna 8. In this embodiment the catalyst 10 are dispersed throughout the formation. The MW and/or RF radiation is capable of heating the steam 2 into superheated steam and revaporized steam, which has a higher temperature than of the original steam. The bitumen 6 is then further heated with this superheated steam and can undergo upgrading reactions. The upgraded hydrocarbons 12 are then produced from the well 4.

Example 3

Comparison of RF Reheating

FIG. 3 shows simulated results of cumulative oil SC production over time, between the a well produced with radio frequency reheating and one without the reheating. From the figure it is clearly shown that with radio frequency reheating the cumulative oil produced is much higher than that without the reheating. In fact, the well that employs radio frequency reheating can have 2,000 $m^3$ more oil. The initial phase before reaching maximum production is also much shorter with the radio frequency reheating.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The following references are incorporated by reference in their entirety.

1. U.S. Pat. No. 6,189,611

What is claimed is:

1. A method of enhancing in situ upgrading hydrocarbon in a hydrocarbon formation, comprising:

a) injecting steam into a well to provide downhole steam;

b) heating the hydrocarbon in the hydrocarbon formation with the downhole steam;

c) ceasing the injection of steam into the well;

d) soaking the hydrocarbon with the downhole steam, wherein a portion of the downhole steam becomes water;

e) reheating the downhole steam and water to produce superheated steam and revaporized steam by directing an electromagnetic radiation to the downhole steam and water, wherein said superheated steam has a temperature of 250° C. or higher;

f) heating the hydrocarbon with the superheated steam and the revaporized steam;

g) soaking the hydrocarbon with the superheated steam and the revaporized steam; and h) producing the hydrocarbon from the well;

i) wherein the temperature of the superheated steam is higher than the temperature of the originally injected steam from step a).

2. The method of claim 1, wherein a catalyst is added to the hydrocarbon or added to a liner of the well or is placed inside said well.

3. The method of claim 2, wherein the catalyst is metal sulfides, metal carbides, refractory type metal compounds, and the combination thereof.

4. The method of claim 2, wherein the catalyst is a metal sulfide selected from a group consisting of MoS2, WS2, CoMoS, NiMoS, and the combination thereof.

5. The method of claim 2, wherein the catalyst is MoC, WC, or the combination thereof.

6. The method of claim 2, wherein the catalyst is a refractory type metal compound selected from the group consisting of metal phosphides, metal borides, and the combination thereof, and wherein the refractory type metal is selected from the group consisting of niobium, molybdenum, tantalum, tungsten and rhenium.

7. The method of claim 1, wherein the temperature of the superheated steam is sufficient catalytically crack the hydrocarbon.

8. The method of claim 1, wherein the temperature of the superheated steam is greater than 350° C.

9. The method of claim 1, wherein the RF is at 100-1000 MHz.

10. A method of enhancing in situ upgrading hydrocarbon in a hydrocarbon formation, comprising:

a) injecting steam into a well;

b) heating the hydrocarbon in the hydrocarbon formation with the injected steam;

c) ceasing the injection of steam into the well;

d) soaking the hydrocarbon with the injected steam, wherein a portion of the injected steam becomes water;

e) reheating the injected steam and water to produce superheated steam and revaporized steam by directing an electromagnetic radiation to the injected steam and water, wherein said superheated steam has a temperature of 250° C. or higher;

f) heating the hydrocarbon with the superheated steam and the revaporized steam;

g) soaking the hydrocarbon with the superheated steam and the revaporized steam; and h) producing the hydrocarbon from the well;

i) wherein the temperature of the superheated steam is higher than the temperature of the injected steam and the revaporized steam; wherein a catalyst is added to the hydrocarbon or added to a liner of the well or inside said well; and wherein the temperature of the superheated steam is sufficient to catalytically crack the hydrocarbon.

11. The method of claim 10, wherein the catalyst is metal sulfides, metal carbides, refractory type metal compounds, and the combination thereof.

12. The method of claim 10, wherein the catalyst is a metal sulfide selected from a group consisting of MoS2, WS2, CoMoS, NiMoS, and the combination thereof.

13. The method of claim 10, wherein the catalyst is MoC, WC, or the combination thereof.

14. The method of claim 10, wherein the catalyst is a refractory type metal compound selected from the group consisting of metal phosphides, metal borides, and the combination thereof, and wherein the refractory type metal is selected from the group consisting of niobium, molybdenum, tantalum, tungsten and rhenium.

* * * * *